US005114056A

United States Patent [19]

Frye

[11] Patent Number: 5,114,056

[45] Date of Patent: May 19, 1992

[54] PLEATING METHOD AND APPARATUS

[75] Inventor: Ricky J. Frye, Miamisburg, Ohio

[73] Assignee: MIM Industries, Inc., Miamisburg, Ohio

[21] Appl. No.: 579,916

[22] Filed: Sep. 7, 1990

[51] Int. Cl.[5] ..... A41H 43/00

[52] U.S. Cl. ..... 223/30; 223/28; 223/31; 26/21

[58] Field of Search ..... 223/28, 30, 31, 33, 223/34, 37, 38; 26/21; 112/25, 26, 144, 145, 133; 493/419, 421

[56] References Cited

U.S. PATENT DOCUMENTS

| | | | |
|---|---|---|---|
| 2,817,468 | 12/1957 | Brown | 223/30 |
| 2,850,218 | 9/1958 | Gibson et al. | 223/28 X |
| 2,906,441 | 9/1959 | Liebeskind | 223/28 |
| 3,824,964 | 7/1974 | Ryan | 223/30 |
| 4,157,775 | 6/1979 | Soto | 223/34 |
| 4,238,060 | 12/1980 | Weir | 223/37 |
| 4,599,958 | 7/1986 | Steirs | 223/30 |
| 4,650,102 | 3/1987 | Arbetter | 223/28 |
| 4,917,277 | 4/1990 | Hibbard | 223/34 |

*Primary Examiner*—Werner H. Schroeder
*Assistant Examiner*—Bibhu Mohanty
*Attorney, Agent, or Firm*—Joseph G. Nauman

[57] ABSTRACT

An apparatus for forming pleats in fabric includes a vertically movable head which can accommodate one centrally located rod, or alternatively, two spaced apart rods. One rod is used to form two pleats and the rod is movable towards a work surface to a position where the rod traps fabric between a work surface and the rod. Two gripping arms are laterally movable and grip the fabric and move towards the central rod. If three pleats are desired, the two spaced apart rods are used, and a vertically movable blade positioned below the work surface can be actuated, which moves the blade upwardly intermediate the two spaced apart rods, carrying the fabric with it, forming a first pleat. The same laterally movable arms can be actuated which grip the fabric and move it inwardly towards the central rod, to form the other two pleats.

20 Claims, 7 Drawing Sheets

FIG-7
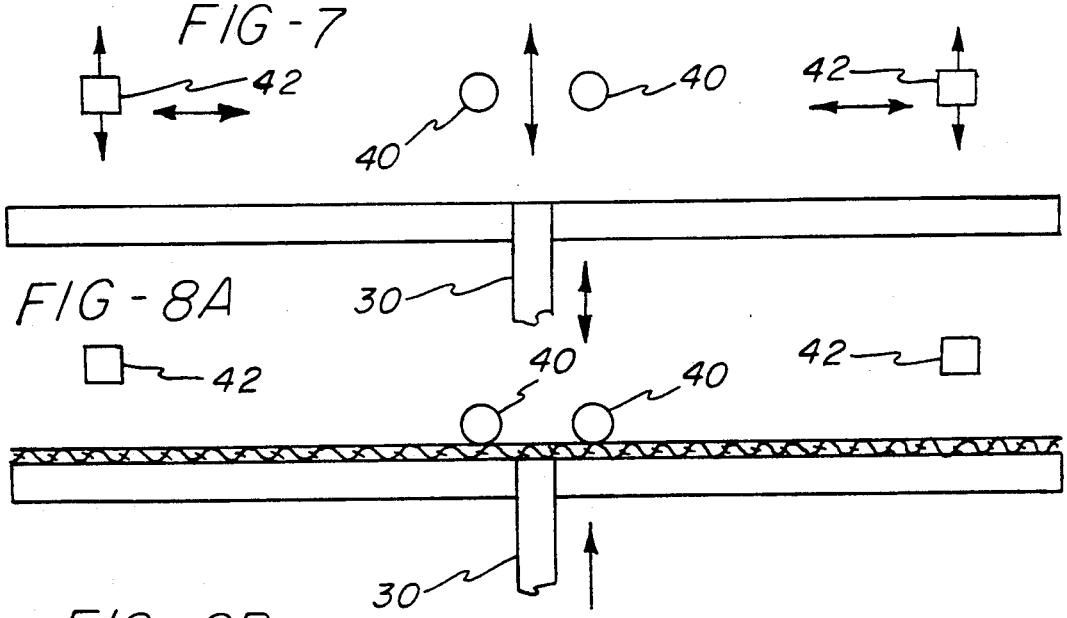
FIG-8A
FIG-8B
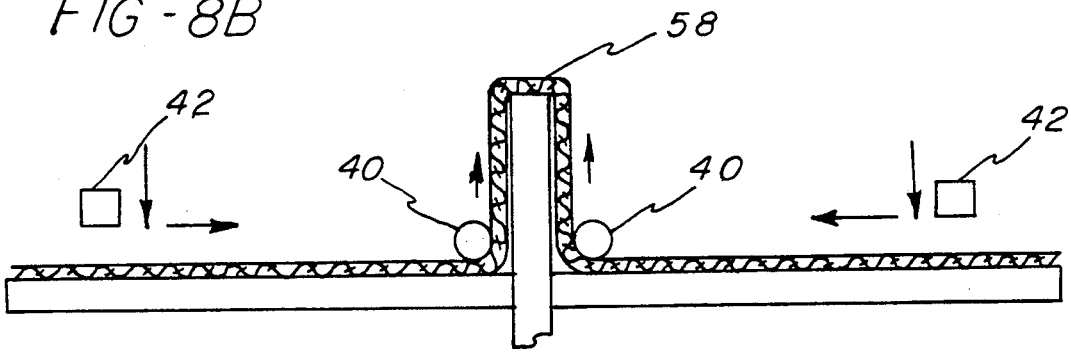
FIG-8C
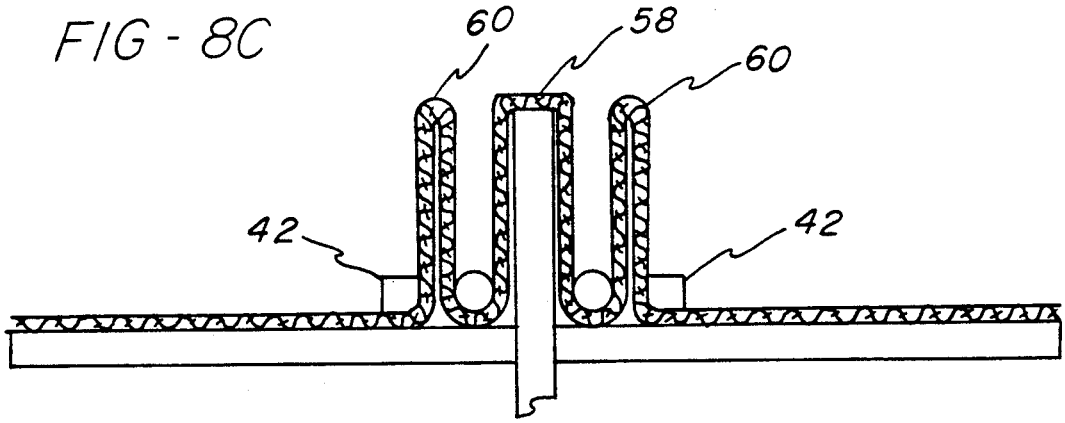
FIG-9
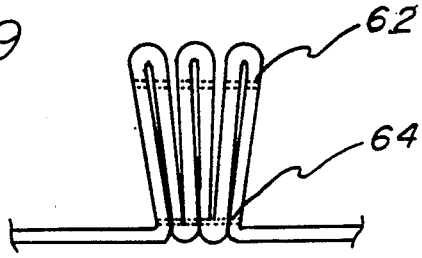

PLEATING METHOD AND APPARATUS

BACKGROUND OF THE INVENTION

The invention relates to a method and an apparatus for forming pleats in compliant material, such as drapery material or the like.

Pleats are usually formed by hand, by a sewing machine operator, and then sewn into place on the machine. The material can be quite thick and stiff, particularly if it is lined, and the operator must gauge the depth of the pleats, fold the material and try to keep that dimension constant in each pleat, and then sew (or otherwise secure) the pleats into final position. Obviously, the more tucks or folds there are in each pleat, the more cumbersome and difficult this operation becomes, requiring considerable dexterity and digital strength, and encountering frustration if the operator loses grasp of the manually formed pleats in the process of forming them.

One apparatus presently exists including fingers which interengage from opposite sides of the material to gather the material and form the pleats. While this apparatus is capable of forming the pleats, this apparatus may be difficult to operate as the centerline of the pleats may move during the formation of the pleat. As the fingers interlock from opposite sides of the material, more material may be drawn from one side of the center finger than the other, causing the center of the pleat to laterally shift during the interlocking phase. This could be a time consuming project as the pleat must be unfolded and again pleated. It is necessary to accurately position the pleat centerlines, as the cosmetic appearance of the completed drapery is dependent upon their position, as the pleats are used to retain hooks upon which the drapes are hung.

SUMMARY OF THE INVENTION

The present invention provides a mechanically assisted method of forming pleats uniformly, and an apparatus for forming pleats to be secured by an operator. A predetermined length of material border, such as the upper edge of a drapery to be pleated, is placed upon a supporting surface and the center of the pleat is clamped to the surface, by one or more cantilever supported central bars extending perpendicularly to the edge of the material. A pair of complementary cantilever supported side arms, extending parallel to the central bar(s), are brought into contact with the material at a predetermined distance to each side of the central bar(s).

In making a double pleat, a single central bar is used, and the side arms are then moved toward the central bar until the material between the side arms and the central bar folds up from the surface and the thickness of the material effectively impedes the centering motion of the side bars. The depth of the fold is one half the distance traversed by the side bars. The operator then grasps the bunched material and simply pulls it forward off the open or free ends of the bars, and moves the folded material into the head of a sewing machine, or some equivalent device for securing the pleat fold together.

When making a triple pleat, two side-by-side bars are used, extending in closely horizontally spaced position, and a central vertically movable blade, normally retracted into the support surface at the center of the apparatus, first moves upward to carry material up a predetermined distance between the central bars, thus forming the center of the three folds. The extent of this lifting motion determines the depth of the central pleat fold. Then the side arms are engaged with the material and moved inward, to form the two outer folds. The extent of the side arm lateral movement is selected to form pleats equal in depth to the central one. The operator can then withdraw the triple folded portion from the apparatus, and proceed to secure the pleat, as in a sewing machine or other suitable device.

In a semi-automatic form of apparatus, according to the invention, motion of the various cantilever mounted bars, and of the vertically movable central plate when used, is controlled by a foot operated treadle which progressively engages a plurality of switches. These switches in turn actuate linear motion devices, such as pneumatic cylinders, to raise and lower the central bar(s), raise and lower the folding plate when used, and to both raise and lower and to move laterally the side arms. The control circuit for this apparatus is straightforward and can be switched between the different cycles necessary to form double or triple pleat folds as described. Also, adjustable mounting is provided for the cylinders controlling lateral motion of the side bars, and for the stroke of a cylinder controlling the raising and lowering of the central fold plate, to vary the depth of the folds in the pleats. The cantilever mounting for the central bars includes appropriately placed sockets and quick-connect fastening, so the change between a single and a double central bar configuration can be accomplished quickly, without use of tools.

Accordingly, the principal object of the invention is to provide a novel method of forming pleats in compliant material; to provide such a method which is mechanically assisted to assure uniformity of successively formed pleats; to minimize operator fatigue in a pleating operation; to provide a pleat folding apparatus which is cycle controlled and forms uniform pleats of predetermined yet adjustable dimensions; to provide a pleat forming/folding apparatus with cycle adjustment and optionally used parts so as to selectively fold at least double and triple fold pleats.

Other objects and advantages of the invention will be apparent from the following description, the accompanying drawings and the appended claims.

BRIEF DESCRIPTION OF THE DRAWINGS

FIGS. 7 through 9 are diagrammatical views of the manufacturing of a triple pleat;

DETAILED DESCRIPTION OF THE PREFERRED EMBODIMENT

Figures 1, 1A:
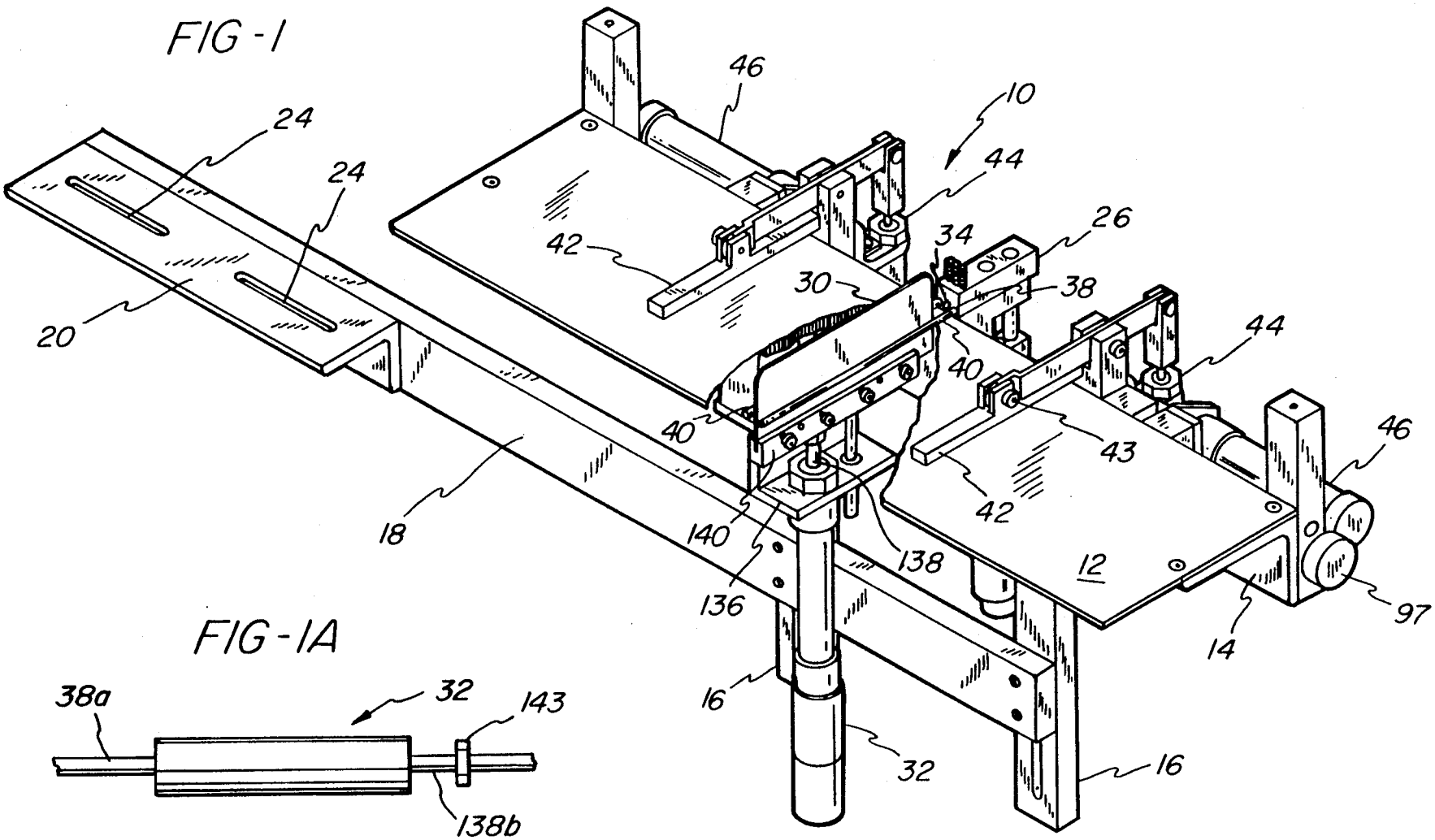
FIG. 1 is a frontal isometric view of the apparatus partially cut away to show the blade in its upright position.
FIG. 1A is a diagrammatical view of the air cylinder which operates the central blade.
Figure 2:
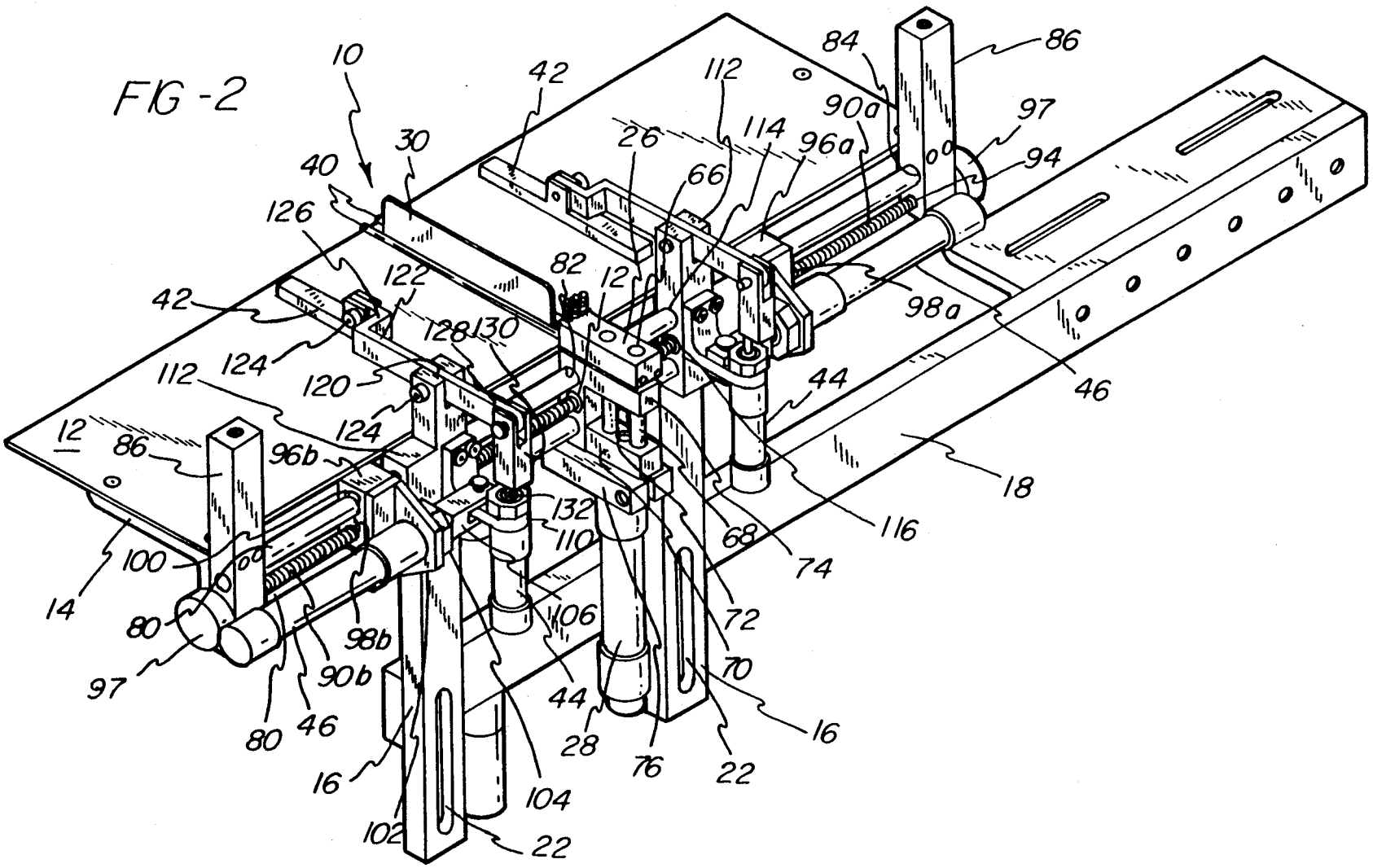
FIG. 2 is an isometric view from the opposite direction of the apparatus again showing the blade in its upright position.
Figure 3:
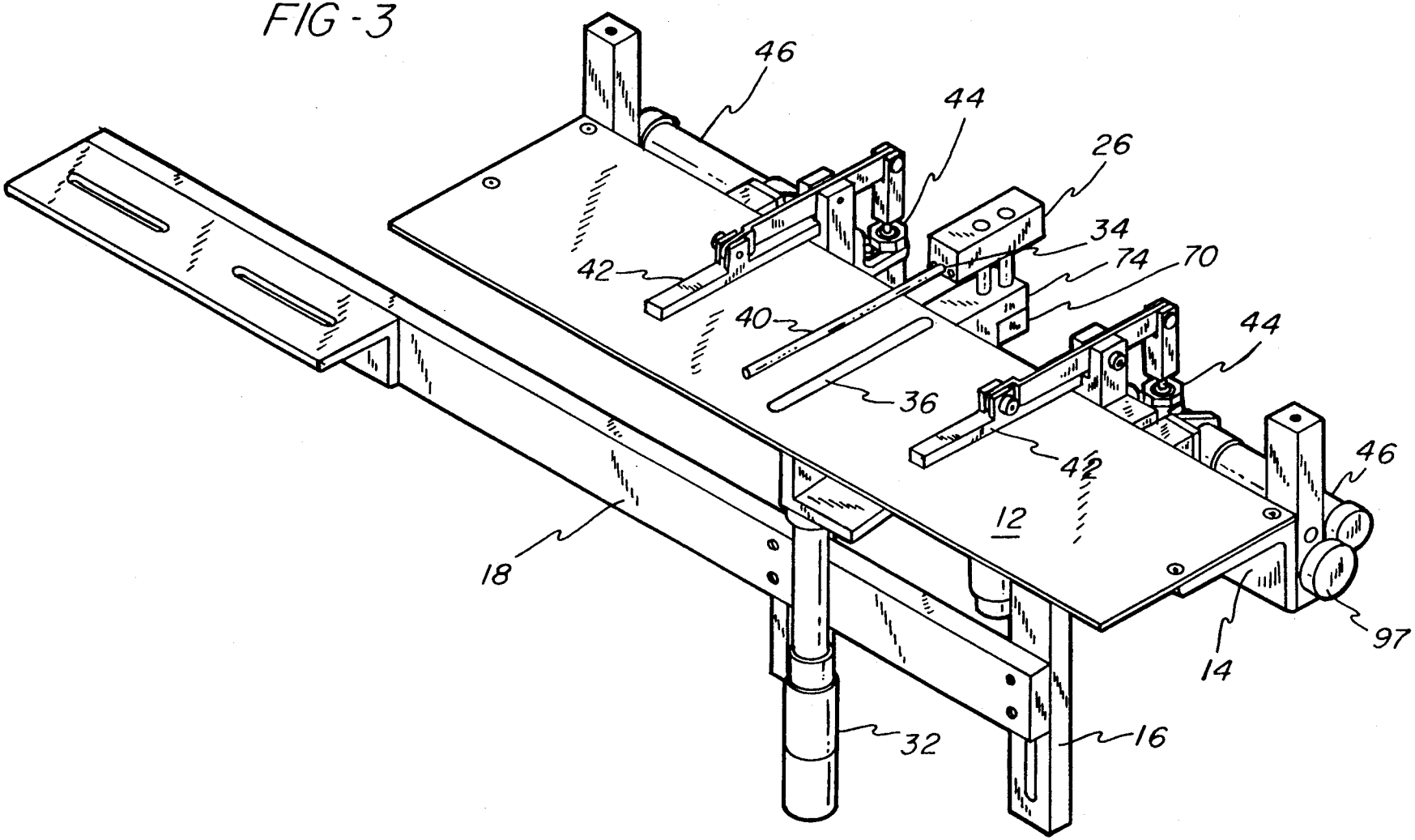
FIG. 3 is a view similar to that of FIG. 1 showing the apparatus in the configuration for manufacturing two pleats in the fabric.

With reference first to FIG. 1, an apparatus is shown generally at 10 for forming either double or triple pleats in fabric materials, such as for curtains or drapes. The apparatus 10 generally comprises an upper work surface 12 supported by an L-bracket 14 which in turn is supported by vertical uprights 16. The vertical uprights 16 are held in position by a cross-brace 18 which can be supported to a further working apparatus, preferably a sewing machine (not shown), via L-bracket 20. The positioning of the apparatus 10 relative to the sewing machine is via the elongate slots 22 (FIG. 2) in the vertical upright 16, and the elongate slots 24 in the L-bracket 20. The apparatus 10 further comprises a head member 26 vertically movable under the operation of an air cylinder 28 (FIG. 2) and a central blade portion 30, which is normally positioned below the upper work surface 12, and is operational by means of an air cylinder 32 (FIG. 1). As shown in FIG. 1, the vertically movable head 26 includes three side-by-side apertures, a center aperture 34 which is aligned with a central slot 36 (FIG. 2) through the upper work surface 12, and two apertures 38 which span the central slot 36. As will be explained more fully herein, the head member 26 can either carry two rods 40 which span the slot 36 (FIGS. 1 and 2) or can carry a single rod 40 which is aligned with the slot 36 (FIG. 3). As also shown in FIGS. 1 and 2, the apparatus further comprises gripping arms 42 which are pivotal at 43 via air cylinders 44, thereby moving the arms 42 toward and away from the upper work surface 12, and are laterally movable via air cylinders 46. While the apparatus will be described in greater detail hereafter, the general function of the machine will now be described diagrammatically with reference to FIGS. 5 through 9.

Figure 4:
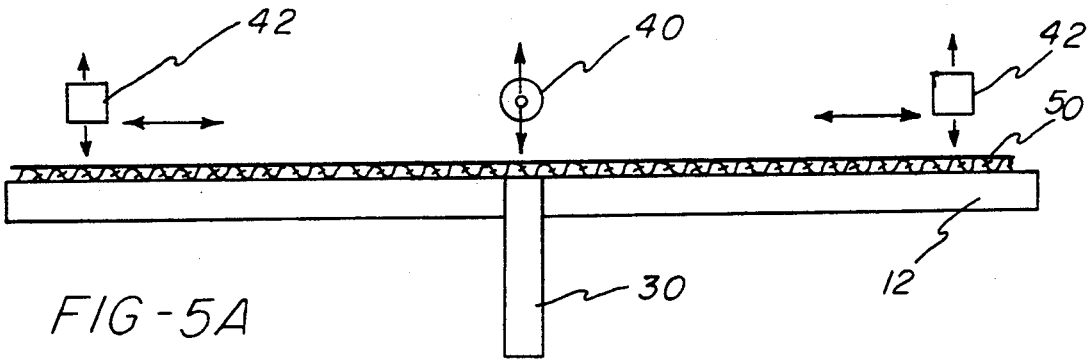
FIGS. 4 through 6 are diagrammatical views of the manufacturing of a double pleat.
Figure 5A:
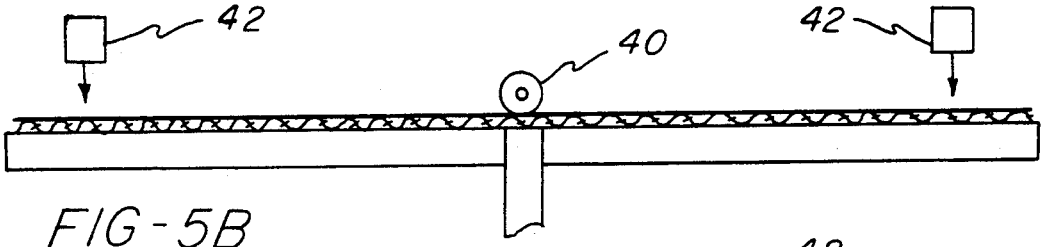
Figure 5B:
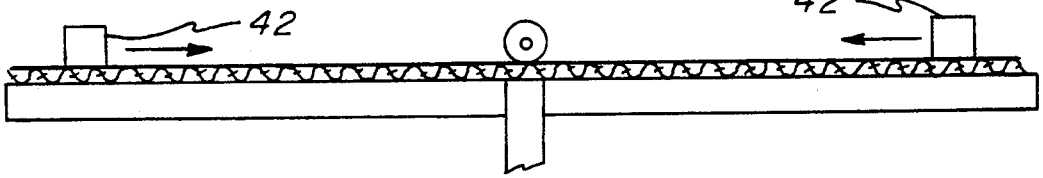
Figure 5C:
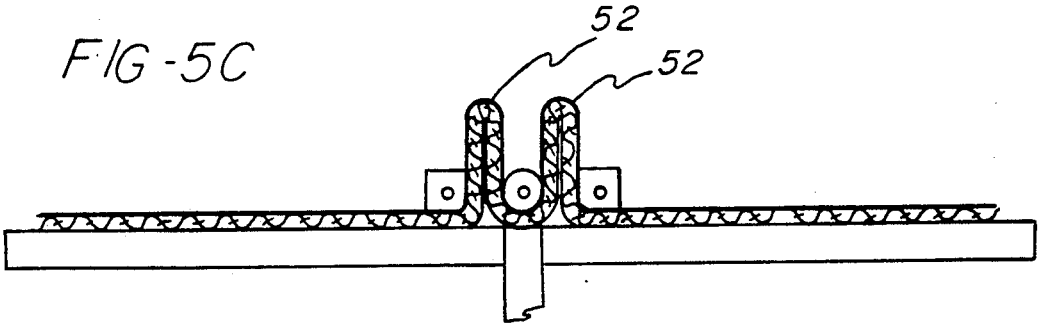
Figure 6:
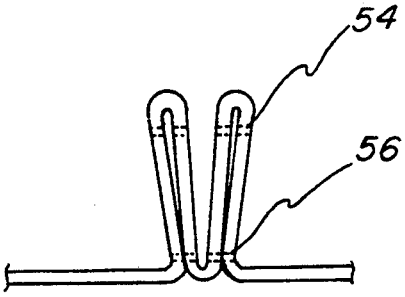

As mentioned above, the apparatus 10 is interchangeable for alternatively producing either two or three pleats in fabric material. With reference first to FIG. 4, the function of the apparatus will be described where two pleats are desired. A piece of fabric shown generally at 50 is positioned on top of the work surface 12 with a center of the desired pleat aligned with a single central rod 40 positioned in the central opening 34 in the vertically movable head 26. Also when two pleats are required, the lower blade 30 is disabled and is in a fixed vertical position below the upper work surface 12 as shown in FIG. 3. After the fabric 50 is positioned on the upper work surface 12, the central cylinder 28 is actuated which moves the central rod 40 downwardly to a clamping position as shown in FIG. 5A to retain the fabric from laterally shifting during the operation. As also shown in FIG. 4A, the gripping arms 42 are also vertically movable downwardly to a position where they grip the fabric as shown in FIG. 5B, and are thereafter moved laterally inwardly towards each other and towards the central clamping rod 40 thereby gathering and folding the material 52 to provide two pleats shown generally at 52. The height of the pleat is equal to one-half the distance between the center rod 40 and the side arms 42. The two pleats can then be grasped by the operator and stitched, as indicated at 54, 56, to affix the two pleats, as shown in FIG. 6.

With reference now to FIG. 7, if three pleats are desired, the apparatus is configured with two rods 40 positioned in the two openings 38 spanning the central slot 36, and the blade member 30 is vertically actuable. The operation begins with the two rods 40 pressing against the fabric as shown in FIG. 8A. The rods 40 do not clamp the material tightly to the surface 12, but rather only press against the fabric sufficiently to prevent the material from laterally shift during the lateral gathering of the pleats. The blade member 30 is thereafter vertically movable upwardly through the slot 36 intermediate the two rods 40, carrying with it the material 50 as shown in FIG. 8B. After the blade member 30 has moved upwardly through the slot 36 to the height of the pleat 58, the gripping arms 42 are moved vertically downwardly as shown in FIG. 8B and then laterally inwardly as shown in FIG. 8C to define two further pleats 60 on opposite sides of the central pleat 58. The three pleats can then be removed from the apparatus and stitched at 62 and 64 fixing the three pleats in the fabric.

With reference again to FIGS. 1 and 2, the apparatus 10 will be described in greater detail. As shown best in FIG. 2, the vertically movable head 26 is pinned at 66 by pins 68, which are pinned at their opposite ends to a vertically movable block 70. The block 70 is pinned at 72 to the rod (not shown) of the air cylinder 28. Both blocks 26 and 70 are movable relative to an L-shaped block 74 which includes vertically oriented apertures which receive the vertical pins 68 in close tolerance through apertures in an L-shaped block 74 which in turn is retained to the vertical portion of the angle bracket 14. The body of the air cylinder 28 is held by brackets 76 which are also connected to the L-bracket 14. As shown best in FIG. 2, two guide rods 80 extend through apertures 82 of the L-shaped block 74 and are laterally fixed thereto, for example, by snap rings (not shown). The guide rods 80 extend the length of the work surface 12 and extend through apertures 84 in end posts 86, also fixed to the L-bracket 14.

With reference still to FIG. 2, a central threaded shaft or worm 90 also extends through an aperture 92 of the L-bracket 74 and is laterally fixed via means such as snap rings (not shown), but is not threaded to the aperture 92, so as to be rotatable within the aperture 92. The worm 90 spans the length of the upper work surface 12 and extends through apertures 94 in the end posts 86 and clears the apertures 94 so as to be freely rotatable therein. The worm 90 includes a knob 97 positioned at both ends for the manual rotation of the worm 90.

As shown in FIG. 2, the worm has two threaded portions 90*a* and 90*b* where the threaded portions are oppositely directed, that is, threaded portion 90*a* is a right-hand thread whereas the threaded portion 90*b* is a left-hand thread. The threaded portion 90*b* is cooperable with threaded blocks 96*a* and 96*b* having threaded apertures 98*a* and 98*b* therethrough which upon rotation of the worm 90 causes the lateral movement of the blocks 96*a* and 96*b* towards and away from the center L-shaped block 74. The blocks 98*a* and 98*b* further include guide apertures 100 which are slidable along the two guide rods 80 to prevent the blocks 96*a* and 96*b* from binding on the respective worm gear portions 90*a* and 90*b*. A bracket member 102 is fixed to each of the blocks 96*a* and 96*b*, where the air cylinder 46 is attached to the bracket 102 via a fastener, such as 104. The air cylinders 46 each have a clevis 106 fixed to their rod ends (not shown) and are pinned at 108 to a bracket 110 fixed to a movable block portion 112 which are slidable along the rods 80 via apertures 114. The block 112 also includes an aperture 116 therethrough which is profiled larger than the worm 90 to allow the worm to rotate therein. With reference still to FIG. 2, the block member 112 includes an upper slot 120 having a rocker arm 122 pinned at 124 where one end 126 is pinned to the gripper arm 42 and the second end 128 is pinned to a clevis 130 which in turn is connected to the rod 132 of the air cylinder 44. Finally, with reference to FIG. 1, the air cylinder 32 is connected to an L-bracket 136 fixed relative to the upper support surface 12. The air cylinder 32 includes a cylinder rod 138 fixed to a slotted bar 140 which carries the blade member 30.

With reference now to FIGS. 1 through 3, the operation of the apparatus will be described in greater detail. With reference first to FIG. 3, if two pleats are desired, the blade 30 is disengaged and one single rod 40 is positioned in the central aperture 34. As shown in FIG. 1, the head 26 includes spring loaded ball detents 141 which spring load against a recess (not shown) at the ends of the rods 40 to retain and accurately position the rods in place. The apparatus 10 is configured for operation with the vertical head 26 in its fully upright position with the rod 40 spaced above the upper work surface 12, as shown in FIG. 3. The fabric can now be inserted beneath the rod 40 and the gripping arms 42, such that the center of the desired pleats is laterally aligned with the rod 40. The head 26 is now activated thereby lowering the rod 40, clamping the fabric to the upper work surface 12. The cylinders 44 are now activated causing the arms 122 to pivot about pins 124 thereby forcing the gripping arms 42 against the fabric. The cylinders 46 can now be actuated which, through the clevis 106, operates to laterally move both carriages 112 towards the center clock 74 carrying with it the fabric in a folded-over manner, as shown diagrammatically in FIG. 5C. The height of the pleats can be easily varied by way of the rotatable knob 97 which rotates the worm gear 90 thereby moving the threaded blocks **96*a* and 96*b* and the gripping arms 42, towards or away from the center block 74**.

To operate the apparatus 10 to provide three pleats, the rods 40 are positioned in the apertures 38 spanning the slot, while the aperture 34 is left blank. With the two rods and the gripping arms 42 spaced above the upper work surface 12, the fabric is insertable onto the work surface 12 such that the center line of the pleats is intermediate the two rods 40. The operation begins with the lowering of the movable head 26 which presses the fabric against the upper work surface 12 and the cylinder 32 is thereafter activated bringing the blade through the slot 36 which draws a portion of the fabric beneath the rods 40 defining a first upstanding pleat. It should be appreciated that the rods are held against the fabric so as to resist the lateral movement of the fabric but to allow the fabric to slide through the rods upon extension of the blade. The gripping arms 42 are thereafter lowered, through the actuation of the cylinders 44, to a position where they are contacting the fabric and the cylinders 46 are thereafter operated to laterally move the gripping arms inwardly towards the blade 30 defining pleats on opposite sides of the first pleat formed by the blade 30.

Once again, the pleats can be adjusted in height by the raising and lowering of the blade, and through the use of the work gear which laterally spaces the gripping arms 42 from the center blade 30. As shown in FIG. 1A, the air cylinder 32 includes a double ended rod 138 having a portion **138*a* extending from the upper portion of the cylinder body and which is connected to the blade 30. At the opposite end of the cylinder body, a rod portion 138*b* extends rearwardly, but is continuous with the rod portion 138*a* so as to move longitudinally therewith. The rod portion 138*b* is normally enclosed by the cover 142 as shown in FIG. 1. The rod portion has affixed thereto, a split collar 143 which can be moved along the rod portion 138*b* and resecured at a new position, to change the maximum height of the blade portion 30**, and thereby change the height of the middle pleat to correspond to the height of the outer pleats.

Figure 10:
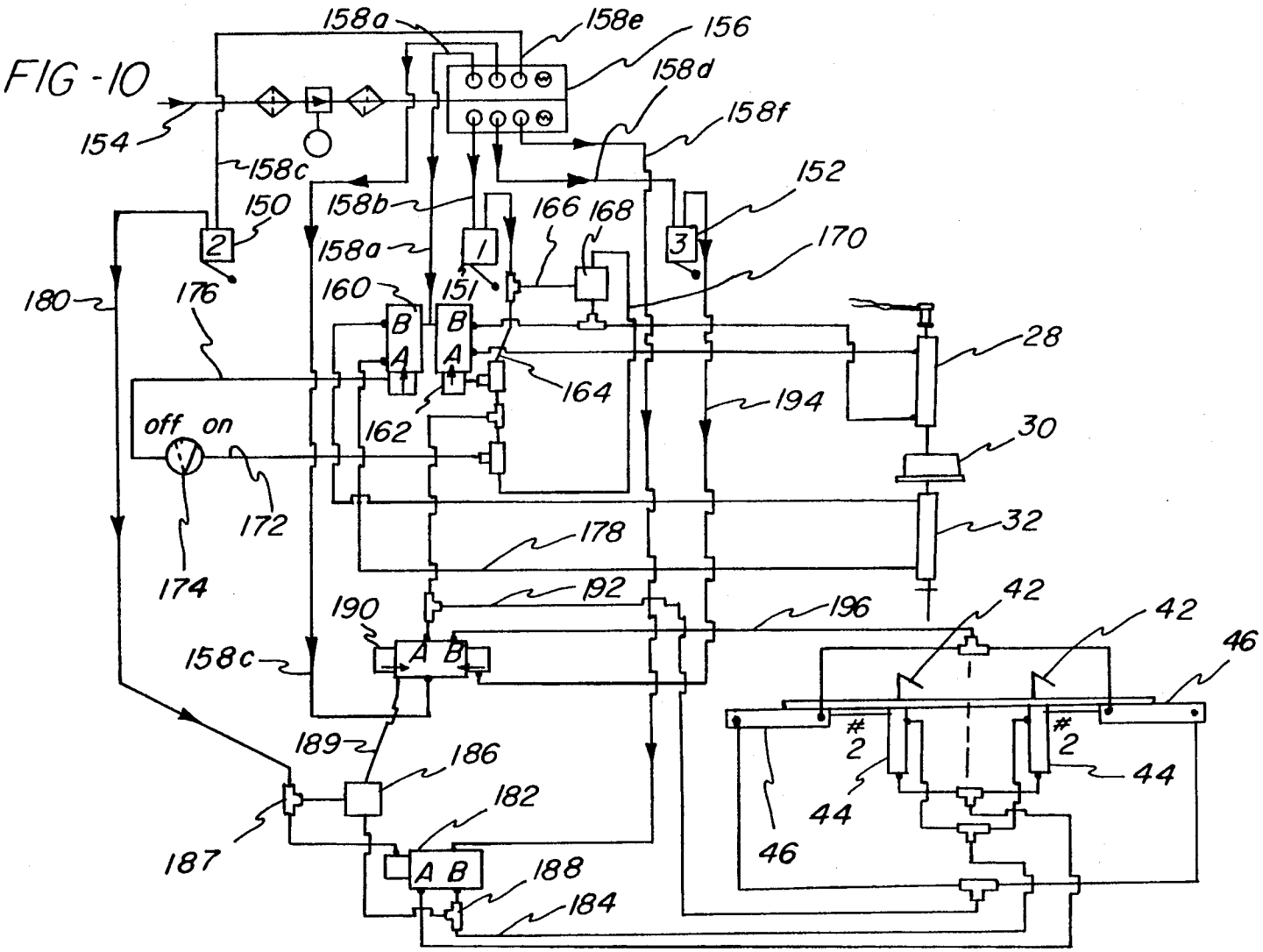
FIG. 10 is a schematic view of the pneumatic system which operates the subject apparatus.
Figure 11:
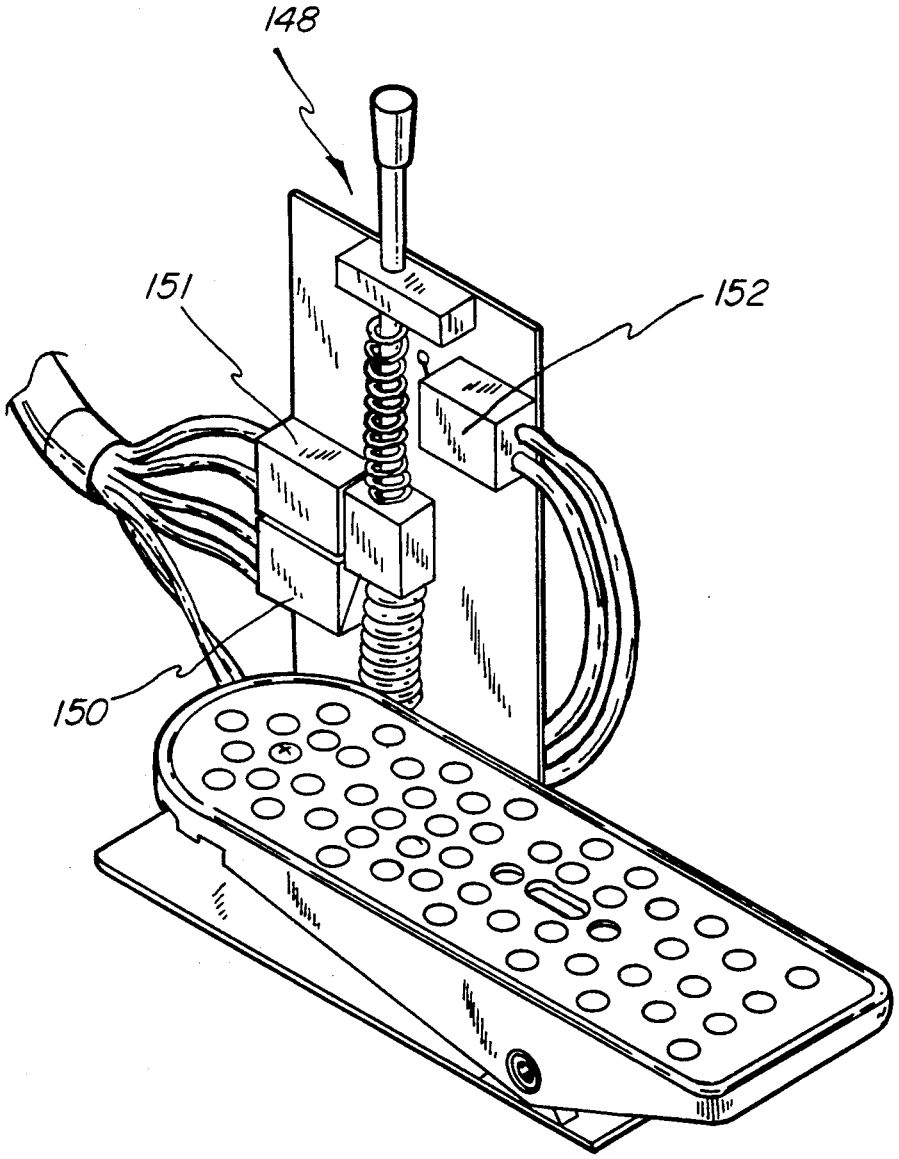
FIG. 11 is an isometric view of the foot treadle which operates the subject apparatus.

The pneumatic sequencing of the apparatus will now be explained by way of reference to the schematic of FIG. 10. The sequencing of the apparatus is generally controlled by a foot treadle shown generally at 148 in FIG. 11 carrying pneumatic limit switches 150, 151, and 152, also shown schematically in FIG. 10. As shown in FIG. 10, a supply line 154 supplies pneumatic pressure to a manifold 156 having a plurality of output supply lines **158*a*–158*f*. A supply line 158*a* feeds two control valves 160 and 162 where the valve 160 controls the vertical movement of the blade 30, and the control valve 162 controls the center vertical head 26. Both of the control valves 160 and 162 are pilot operated and spring returned. Limit switch 151 receives a supply signal through line 158*b* which, when activated by way of the foot treadle, sends this signal through line 164 thereby acting as the pilot to operate the valve 162 and lowering the air cylinder 28 and the rod 40**.

The air cylinder 32 which operates the blade is also operated through the first limit switch, however, the blade is sequenced to operate after the complete cycling of the air cylinder 28. A T-connection off of line 164 presents a signal through 166 to a threshold not 168 which measures the pressure across the air cylinder 28. When the back pressure on the back side of the air cylinder 28 is at atmospheric pressure (when the air cylinder is in its fully retracted position), the threshold not 168 allows a pilot signal through lines 170 and 172 to the valve 174. If the apparatus is in the two pleat mode, the valve is in the OFF position and the pilot signal stops at the valve 174 and the blade is not activated. If the apparatus is in the three-pleat mode, however, the valve 174 is in the ON position and the pilot signal through line 172 passes through the valve 174 and acts as a pilot signal through line 176 to the pilot operated valve 160 thereby sending the pneumatic signal through line 178 thereby raising the air cylinder 32 and the blade 30.

Limit switch 150 operates the air cylinders 44 and 46 and when the limit switch 150 is activated, a supply signal through line **158*e* is supplied to line 180 which acts as a pilot to valve 182 thereby activating the air cylinders 44 through pneumatic pressure through the line 184. A threshold NOT sensor 186 senses the differential pressure across the air cylinders 44 by connections at 187 and 188 and when the pressure across the cylinder is equalized (when the cylinders are in their fully retracted position), the threshold NOT sensor 186 sends a pilot signal at 189 to a double pilot three-way valve 190, which receives a supply signal through line 158*c*, thereby sending a supply signal through line 192 to operate the air cylinders 49 to move the gripping arms 42** laterally inward.

To reset the entire system, the foot treadle is pivoted in the opposite sense to activate the pilot switch 152 which sends a supply signal from line **158*d* through to line 194 thereby activating the opposite side of the double pilot three-way valve 190 causing a signal through line 196 retracting the arms to their laterally spread position. As the treadle is moved to the pivoted position, the switches 150 and 151 are also released causing the valves 160, 162, and 182 to spring return thereby causing the retraction of the rods of the air cylinders 28 and 32, and the extension of the rods of the air cylinders 44**.

While the method herein described, and the form of apparatus for carrying out this method into effect, constitute preferred embodiments of this invention, it is to be understood that the invention is not limited to this precise method and form of apparatus, and that changes may be made in either without departing from the scope of the invention, which is defined in the appended claims.

I claim:

1. An apparatus for gathering pleats in fabric, the apparatus comprising:

a rigid base member having an upper work surface fixed thereto for supporting the material to be pleated;

a head member fixed above said work surface, said head member being vertically movable upwardly and downwardly relative to said upper work surface, between upper and lower positions;

means to move said head member between said upper and lower positions;

at least one holding rod retained and carried by said head member, said holding rod being movable with said head member between said upper and lower positions, said upper position allowing the material to be slidably placed between said holding rod and said work surface, and said lower position pressing the material to said work surface;

means to retain said rod to said head member;

two gripping arms vertically movable towards and away from said work surface, from a first position allowing the material to be slidably received between said arms and said work surface, to a second position adapted to grip the material; and means to move said gripping arms laterally towards said holding rod to carry the material inwardly, thereby forming a pleat on each side of said holding rod.

2. The apparatus of claim 1, wherein said apparatus is adapted to produce pleats having different numbers of folds of fabric.

3. The apparatus of claim 2, wherein said retaining means comprises means to retain, two spaced apart holding rods, said two spaced apart rods being used t produce three pleats.

4. The apparatus of claim 3, wherein said upper work surface further comprises a slot therethrough, a blade member positioned beneath said slot and means for moving said blade member upwardly through said work surface and slot, said blade member being cooperable with said two holding rods to push the fabric upwardly of said work surface intermediate said two holding rods to form a first pleat prior to lateral movement of said gripping arms to form pleats at the outside of each said rod.

5. The apparatus of claim 4, further comprising means to disable said means for moving said blade portion when said apparatus is producing two pleats in fabric.

6. The apparatus of claim 1, wherein said head member includes means to retain one central holding rod.

7. The apparatus of claim 1, wherein said head member includes means to retain two parallel spaced apart holding rods.

8. The apparatus of claim 7, wherein said work surface includes a slot therein intermediate said two holding rods, a blade member supported beneath said slot, and means for moving said blade member upwardly relative to said work surface through said slot to push fabric positioned on said work surface upward between said two holding rods to form a first pleat.

9. The apparatus of claim 1, further comprising means to vary the height of the individual pleats.

10. The apparatus of claim 9, wherein the means to vary the pleat height comprises blocks slidably supported on opposite sides of said head member for movement along said work surface toward and away from each other, a worm threadably engaged with said blocks to cause equal and opposite motion of said blocks upon rotation of said worm, and air cylinders connected between said blocks and said gripping arms to produce the lateral movement of said gripping arms, whereby rotation of said worm gear laterally moves said blocks and said gripping arms to change their spaced apart starting positions.

11. The apparatus of claim 2, wherein said retaining means comprises means to retain a central rod for use in producing two pleats.

12. An apparatus for forming pleats in fabric, the apparatus comprising a rigid frame member, a work surface fixed to said frame member having a slot therethrough, two rods positioned above said work surface flanking said slot, a blade member positioned below said work surface and laterally aligned with said slot, said blade member being movable from a position below said work surface, to a position above said work surface intermediate said rods, means for raising said blade member through said slot, whereby, when fabric is inserted above said work surface and below said rods, said blade member is actuable to pull the fabric upward between said rods to form a pleat.

13. The apparatus of claim 11, further comprising two gripper arms, each arms being positioned laterally on opposite sides of said rods, said gripper arms being movable from a position spaced above said work surface to allow the insertion of the fabric between said rods and said surface, to a position against the fabric pressing the fabric against said surface, said apparatus further comprising means to move said gripping arms laterally inward towards said rods gathering the fabric during the lateral movement and forming further pleats at the opposite sides of said rods.

14. The apparatus of claim 12, including means for moving said two rods towards and away from said work surface to hold the fabric after the formation of the first pleat.

15. A method of forming pleats in fabric material, comprising the steps of:

placing a marginal portion of the fabric to be pleated on a horizontal work surface located over a central pleat forming position on such surface;

pressing a narrow band across the marginal portion of the fabric against the work surface at the central pleat forming position;

the fabric along lines parallel with, and equidistant from, said central pleat forming position; and shifting the pressed fabric along the work surface towards said central forming position, thereby folding the marginal portion of the fabric into pleats on opposite sides of and parallel to the narrow band.

16. The method according to claim 15, further comprising the step of:

subsequent to placing the fabric on the work surface and after pressing the narrow band against the work surface, pushing a portion of the fabric at and along the narrow band upward from the work surface to form a first pleat.

17. The method of claim 16, wherein the narrow band of the fabric is pressed against the work surface by positioning two spaced apart pressing rods against the fabric above the central position of the work surface, and the first pleat is formed by pushing the fabric upwardly through the two rods.

18. A method of forming pleats in fabric, comprising the steps of:

positioning a marginal portion of the fabric to be pleated along a generally horizontal plane;

retaining the fabric along a narrow band across the marginal portion defined by two lateral side-by-side lines across the upper surface of the marginal portion of the fabric; and thereafter pushing the marginal portion of the fabric upwardly from a lower surface of the fabric through and medially of the two said lines thereby forming a first folded pleat.

19. The method of claim 18, further comprising the step of:

subsequent to forming the first pleat in the fabric, gripping the marginal portion of the fabric along parallel lines laterally outside and spaced equally from said two lines and then moving the gripped fabric towards the first pleat, thereby gathering the fabric into second and third pleats on opposite sides of said first pleat.

20. An apparatus for forming a selected multiple number of pleats in fabric, the apparatus comprising:

a work platform having an upper support surface, and a slot extending through said work platform and defining a central position of the apparatus;

a blade positioned below said platform and aligned with said slot;

means for moving said blade upwardly through said slot above said work surface;

a vertically movable head and means supporting said head for movement at said central position toward and away from said surface along a plane coincident with said slot, said head having three receptacle positions for pressing members, namely a central position aligned with said slot and two positions flanking said slot;

rod-like pressing members insertable into said head into selected receptacle positions, a single pressing member being insertable into said central position and a pair of cooperating pressing members being insertable into said flanking positions, said pair of pressing members in said flanking positions being used for making three pleats and said single pressing member in said central position being used for making two pleats;

means connected to said head for moving said head between a raised position above said surface and a lowered position at which pressing members received in said head pressing the fabric against said support surface beneath said head, means for selectively actuating said blade moving means to cause said blade to rise between two pressing members to pull the fabric upwardly beneath and between the two pressing members to form a first pleat, gripping arms movable towards and away from said upper work surface into gripping arrangement with the fabric on opposite sides of and spaced along said surface from said central position;

means to move said gripping arms laterally towards said central position when said head is located at its lowered pressing position to form two lateral pleats intermediate the gripping arms and the pressing member received in said head.

* * * * *